United States Patent [19]

Curran

[11] Patent Number: 4,950,200

[45] Date of Patent: Aug. 21, 1990

[54] WHISPERING DOLL

[75] Inventor: Kenneth J. Curran, Thousand Oaks, Calif.

[73] Assignee: CAL R & D, Inc., Culver City, Calif.

[21] Appl. No.: 237,516

[22] Filed: Aug. 26, 1988

[51] Int. Cl.[5] ..... A63H 3/28

[52] U.S. Cl. ..... 446/302

[58] Field of Search ..... 446/268, 297, 302, 299, 446/484, 303, 397

[56] References Cited

U.S. PATENT DOCUMENTS

| | | | |
|---|---|---|---|
| 3,017,187 | 1/1962 | Ryan | 446/302 |
| 3,080,679 | 3/1963 | Hardigan | 446/302 |
| 3,131,497 | 5/1964 | Rogers | 446/302 |
| 3,159,942 | 12/1964 | Fiske | 446/302 |
| 3,162,980 | 12/1964 | Hellman | 446/302 |
| 3,636,655 | 1/1972 | Porter | 446/302 |
| 3,775,960 | 9/1973 | Tepper et al. | 57/243 |
| 4,209,174 | 6/1980 | Shiseki | 446/302 |
| 4,318,245 | 3/1982 | Stowell | 446/303 |
| 4,451,911 | 5/1984 | Klose | 446/302 |
| 4,521,205 | 6/1985 | Spector | 446/302 |
| 4,669,007 | 5/1987 | Fujishige | 446/302 |
| 4,696,653 | 9/1987 | McKeefery | 446/175 |
| 4,710,145 | 12/1987 | Hall Vandis | 446/302 |

*Primary Examiner*—Robert A. Hafer
*Assistant Examiner*—Michael Brown
*Attorney, Agent, or Firm*—Price, Gess & Ubell

[57] ABSTRACT

A doll containing an endless loop tape deck having multiple tracks speaking in a normal tone and volume when a switch in its hand is closed and in a whisper tone and volume when a switch in its chest is closed. Certain tracks of the tape are for whispered message. Other tracks are for normal voice messages. Each of the multiple message segments recorded on the tape may vary in length between segments and between the tracks in a segment. A buffer zone between segments allows all tracks in each segment to que up regardless of the varying length of the messages on each track within the previous segment. A low frequency signal of 40 Hz equalizes the length of the messages on each track within each segment. The low frequency signal overlays the signals on the whisper track. The system will shut off whenever there is more than a short duration of blank space on the track. The 40-Hz signal keeps the tape mechanism active during vocal phrases and during reproduction of the whisper segments.

3 Claims, 2 Drawing Sheets

FIG. 1
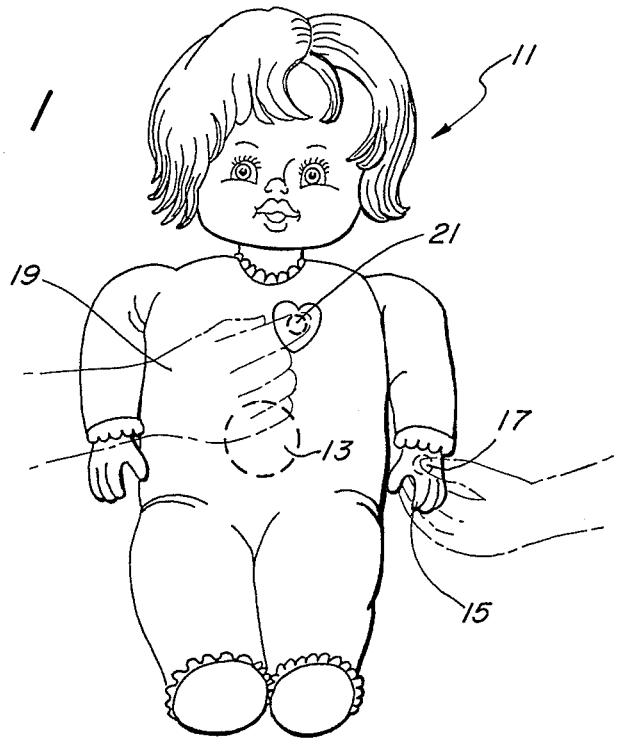
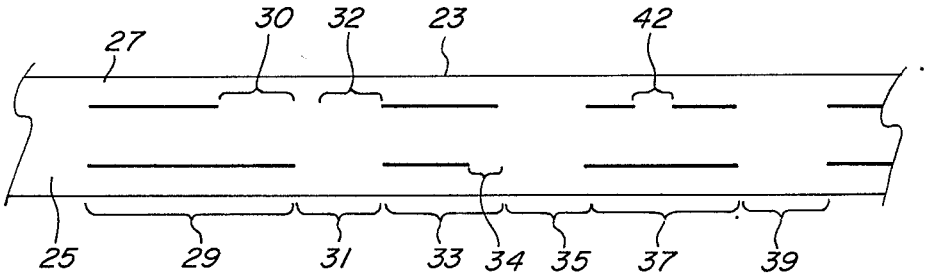
FIG. 2

WHISPERING DOLL

BACKGROUND OF THE INVENTION

1. Field of the Invention

The present invention relates generally to improvements in toy dolls, and more particularly pertains to new and improved talking dolls wherein the doll's speech is activated by physically touching certain parts of the doll's body.

2. Description of the Prior Art

Those concerned with the development of talking dolls have long recognized the problems associated with creating a lifelike-sounding voice from small mechanisms placed in the body of the doll. This problem is compounded by the additional desire to create the illusion of responsive speech. Generally, the prior art has utilized computers and synthesized speech mechanisms responsive either to the spoken word of a human or the touch of a human. Synthesized speech has assured the appearance of responsiveness, but the quality of the voice created is not as human-like as desired. The use of a magnetically-recorded voice, although having a high degree of humanness quality, is lacking in the apparent responsiveness and interaction of the speech pattern that may be generated.

The present invention not only provides a high quality human-like character to the voice being generated, but also provides the appearance of responsiveness by the randomness of the speech pattern. The present invention goes even further by providing something that has heretofore not been available in the prior art. A doll that can speak in a normal volume and tone and at a whispered volume and tone with equal clarity and fidelity, and with the appearance of responsiveness both in the whisper speech mode and in the normal conversational speech mode.

SUMMARY OF THE INVENTION

A talking doll capable of talking at a conversational tone and volume and selectively at a whispered tone and volume is provided by recording the whispered phrases in a separate track from the spoken phrases on a magnetic recording medium. The reproducing system turns itself off after each speech segment when it fails to detect a strong recorded signal for 7/10-second. A 40-Hz signal is superimposed over the whisper segments to keep the reproducing system active and is filtered from the final output. The 40-Hz tone is used to even out the termination of each segment recorded on the tape. For gaps in a conversational segment longer than 7/10-second, the 40-Hz tone prevents the reproduction system from shutting off.

BRIEF DESCRIPTION OF THE DRAWINGS

The objects and many of the attendant advantages of this invention will be readily appreciated as the same becomes better understood by reference to the following detailed description when considered in conjunction with the accompanying drawings, in which like reference numerals designate like parts throughout the figures thereof, and wherein:

FIG. 1 is a perspective illustration showing a doll with the invention incorporated therein;

FIG. 2 is a graphic illustration of a section of the magnetic tape medium on which the voice data is stored in the doll.

DETAILED DESCRIPTION OF THE PREFERRED EMBODIMENTS

Figure 3:
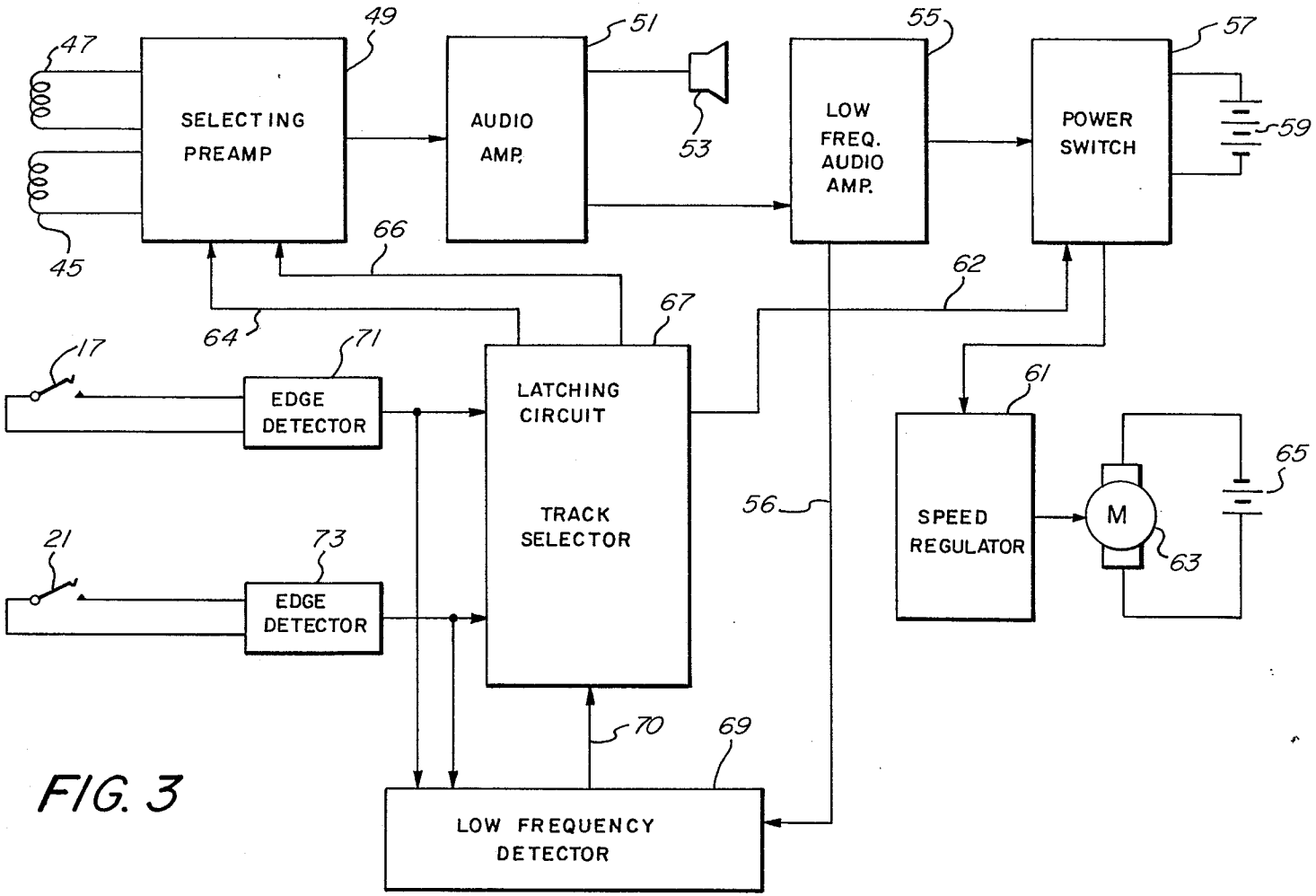
FIG. 3 is a block diagram illustrating how the circuitry is utilized to reproduce the voice data stored on the magnetic tape of FIG. 2.

FIG. 1 illustrates a doll 11 incorporating the voice reproduction system of the present invention. Characteristically, the doll has a head, two arms, two legs, and a body 19. One of the arms has a hand 15 thereon which has contained in its palm, under the synthetic skin, a mechanically actuated switch 17. In its body 19, the doll has another switch 21 located under the skin in the general area of the heart. The doll has a speaker 13 located in the trunk of its body.

Not shown in FIG. 1 is the substantive part of the present invention, the mechanism that stores the speech data, normal voice and whisper voice, and the mechanism which reproduces the speech data signals and feeds them to the speaker 13. Physically depressing the area of the hand 15 containing switch 17 actuates the voice reproduction system to reproduce the normal conversational voice. Physically touching the chest 19 of the doll 11 in the heart area wherein switch 21 is located actuates the voice reproduction system to reproduce the whispering voice.

The reproduction system utilized in the preferred embodiment of the present invention includes a standard Phillips endless loop tape cassette and stereo cassette tape deck, such as manufactured by TDK and similar manufacturers, which has a dual track capability with a dual track head. The concepts illustrated by the preferred embodiment can easily be expanded to a four-track system which utilizes a quad head. Such systems are readily available. The invention, however, should not be construed as so limited. Any number of tracks of recorded data may be advantageously utilized in implementing the concepts of the present invention simply by incorporating the use of the movable head.

Referring now to FIG. 2, the preferred embodiment for storage of the voice data is illustrated as consisting of an endless magnetic tape 23, only a portion of which is shown for purposes of clarity. According to the preferred embodiment, the tape contains two data tracks 25 and 27. One data track 27 is dedicated to the storage of the conversational voice messages. The other data track 25 is dedicated to the storage of whispered voice messages. The messages, which consist of phrases or simple sentences, are arranged in message segments 29, 33 and 37 along the length of the tape 23. Both the whispered message and the normal voice messages of each segment start at the same place on the tape, but on parallel tracks as shown in FIG. 2.

The length of the conversational voice message versus the whispered message need not be the same. As shown for segment 29, the conversational voice message on track 27 is shorter than the whispered voice message on track 25 for that segment. Likewise, for segment 33, the whispered voice message on track 25 is shorter than the conversational voice message on track 27. Regardless of the length of the whispered and conversational voice messages of each segment, a two-second spacing between the end of one segment and the start of another segment is utilized. Spacing 31 between segments 29 and 33 is two seconds long. Spacing 35 between segments 33 and 37 is two seconds long. Spacing 39 following segment 37 is again two seconds long.

The scripts that are recorded on the magnetic recording medium 23 can be varied as desired. An example of the type of messages that can be utilized on track 27 for normal conversational voice are as follows:

"Touch my heart and I'll tell you a special secret."
"I'm your Baby Secret."
"Give your Baby Secrets a kiss."
"Will you fix my hair and make me pretty all over."
"For a secret touch my heart."
"I'm a happy Baby Secrets."
"You're such a special friend."
"I'll tell you a secret if you touch my heart."

Paired with these conversational voice messages are the whispered voice messages which are recorded on track 25. Examples are:

"Isn't this fun?"
"You're such a good friend and that's no secret."
"You're the only one I tell my secrets to."
"Your secrets are safe with me."
"I'm so glad we're together."
"You're really special. Did you know that?"

The tape 23 continuously moves across the tape reproducing head (not shown). By having a longer tape loop with a large number of messages on the loop, the repetitiveness of the messages is not readily apparent. The doll has an apparent randomness of speech. To optimize the effect of randomness a certain number of phrases are repeated in a different order on the tape. Therefore the doll appears to be responsive to the human.

Actuation of either switch 17 or 21 in the doll activates the voice reproduction system. Switch 17 selects the reproduction of the conversational voice signals on track 27. Actuation of switch 21 selects the reproduction of the whispering voice signals on track 25. The system will reproduce only one segment of the voice signals with each switch actuation. This is accomplished by the system sensing the end of a segment occurring within the two-second spacing 31, 35 and 39 between segments, and thereby deactivating.

The deactivation of the voice reproduction system of the present invention is accomplished by a mechanism which will be more fully explained hereinafter. The mechanism responds to any signal of sufficient magnitude on either track 27 or track 25 whichever is being played. As long as a signal is being detected, the reproducing mechanism is maintained active. If no signal is detected for a period of 7/10 of a second, the voice reproducing system is deactivated.

Normal speaking voice signals such as recorded on track 27, for example, in segments 29, 33 and 37, contain an audio signal of sufficient magnitude to keep the system on. The system continues to play as long as the voice frequency pattern is present. As illustrated in segment 29 of FIG. 2, the speaking voice message may be shorter than the whispered voice message on track 25. The portion 30 of the track where no voice signal is recorded has a 40-Hz tone signal recorded thereon. The 40-Hz signal is removed from the final audio by the speaker 13 which due to its size, cannot reproduce this low frequency. This equalizes the lengths of the speaking voice signal on track 27 with the whispering voice signal on track 25. The speaking voice and whispering voice signal lengths are equalized to ensure that the tape does not stop in the middle of a message. For example, the end of the speaking voice message on track 27 for segment 29 is only three-quarters of the way through the whispering voice message on track 25 for segment 29, assuring that the tape stopped after the end of the speaking voice message on track 27 in segment 29. If heart switch 21 were to be pressed in a subsequent operation, only the tail end of the whispering voice message on track 25 of segment 29 would be reproduced, most likely in a garbled and incompressible manner. The mechanism must therefore always stop within the two second gap periods 31, 35 and 39 between segments. The 40-Hz tone filters 30 on track 27 and 34 on track 25 accomplish this end by equalizing the lengths and endings of both conversational voice and whispered voice messages for the purposes of the shutoff mechanism of the present invention.

The 40-Hz tone is also used for other purposes. One of these purposes is to fill in pauses in the conversational voice messages, such as shown in FIG. 2 for segment 37. The conversational voice message on track 27 has more than a 7/10 of a second pause 42 therein. To prevent the mechanism from turning off, this gap must be filled in by a 40-Hz tone. Another, more important purpose for the 40-Hz tone is to prevent the shutoff mechanism from shutting off when the whisper voice signals on track 25 are chosen for reproduction. Because the voice signals recorded on track 25, such as in segments 29, 33 and 37, are actual whispered voices, the volume is low. Detection of an audio signal of sufficient magnitude in the recorded voice is exceedingly difficult, if not impossible, by simple reproduction circuitry. Sensitive, sophisticated detection equipment is much too expensive for the purposes of a toy such as contemplated. The elegant solution to this problem is to superimpose the 40-Hz tone over the whispered voice segments 29, 33 and 37.

To ensure that the electronic reproduction equipment, such as the audio amplifiers, are at their operating parameters prior to the reproducing head coming in contact with the start of the voice segments 29, 33 and 37, for example, the reproducing system is turned on before the actual voice signals are detected. The 40-Hz tone is recorded a short distance 32 before the start of each voice segment on track 27 and track 25.

Assuming that the recorded message of segment 29 had just been played, either the conversational voice message on track 27 or the whispered voice message on track 25 and the message ended at the end of segment 29, 7/10 of a second after the end of segment 29, the system would shut off. This would place the reproducing head a little more than halfway between the end of the 40-Hz section 30 and the start of the 40-Hz section 32. The time gap between these two sections should be somewhat less than 1.4 seconds, and preferably could be 1.0 second. The reason for this is that if either switch 17 or switch 21 is pressed while the head is so located, if it went more than 7/10 of a second without detecting a 40-Hz signal, the mechanism would again shut off. Therefore, it must travel less than 7/10 of a second before it detects the 40-Hz tone at segment 32, turning on the equipment. By the time the next voice segment 33 is reached, all the amplifiers are at their operating parameters and a fine quality voice signal is reproduced by speaker 13 (FIG. 1).

Referring now to FIG. 3, which illustrates the preferred embodiment of a battery-operated mechanism for reproducing the conversational voice and whisper voice signals on tracks 27 and 25, respectively, a pair of electromagnetic reproducing heads 47 and 45 sense the recorded signals on tracks 27 and 25, respectively. These sensed signals are simultaneously supplied to a selecting preamplifier 49 of standard construction which will pass either the signal from magnetic head 47 or magnetic head 45, depending upon whether a signal on line 66 or on line 64 is received from the latching track selector circuit 67.

The latching track selector circuit 67 is responsive to a pair of edge detectors 71 and 73. Detector 71 is responsive to the closure of switch 17 (in the hand of the doll). Detector 73 is responsive to the closure of switch 21 (over the heart of the doll). Thus, if the hand is squeezed and switch 17 is closed, edge detector 71 provides a signal to latching track selector 67. Circuit 67 generates a signal on line 66 to selecting preamplifier 49, causing it to pass the signals being detected by electromagnetic head 47 to audio amplifier 51. Audio amplifier 51 amplifies the signals and passes them to speaker 53.

At the same time that latching track selector circuit 67 is activating selecting preamplifier 49, it is turning on the entire mechanism by providing an enabling signal over line 62 to power switch 57. Power switch 57 is simply an electronic switch that supplies the voltage generated by 9-volt battery 59 to speed regulator circuit 61. The speed regulator circuit regulates the speed of tape drive motor 63. Tape drive motor 63 is powered by its own battery source 65. Thus, although selecting preamplifier 49 is activated, no signal can be passed to audio amplifier 51 until tape motor 63 is running. Actuation of power switch 57 by a signal on line 62 starts the tape motor 63 running.

At the same time that edge detector 71 supplies an enabling signal to latching track selector circuit 67, a signal is applied to low frequency detector 69. This is a time-out circuit which simply generates a reset signal on line 70, causing latching track selector circuit 67 to reset. When latching circuit 67 resets, the enabling signals on lines 66, 64 and 62 are removed. Low frequency detector 69 generates this reset signal on line 70 only if it does not receive an audio signal over line 56 from low frequency audio amplifier 55 for a certain predetermined period of time.

In the preferred embodiment of this invention, 7/10 of a second has been selected as the length of time after which a reset signal is generated on line 70. Upon generation of a reset signal, latching track selector 67 disables power switch 57, causing the drive motor 63 to stop.

The above explanation regarding the starting and stopping of the audio reproduction system of the present invention as illustrated in FIG. 3 applies equally to a situation where switch 21 is pressed.

Another feature of the present invention is that latching track selector circuit 67 will not jump from voice tracks to whisper track simply because the heart switch 21 is pressed shortly after the hand switch 17 is pressed. Once a switch is pressed, either hand switch 17 or heart switch 21, latching circuit 67 will not recognize another switch closure until it has been reset by a signal over line 70 from low frequency detector 69.

What is claimed is:

1. In a toy, a voice reproduction system responsive to the touching of switches located in the body of the toy, said voice reproduction system comprising:

a multitrack tape recording/reproducing system located within the toy's body, said system comprising:

at least a pair of magnetic reproducing heads;

a selecting preamplifier means for receiving the signals from the reproducing heads and amplifying the signals from one of said heads as directed;

a latching track selector means responsive to a plurality of switch closures for directing said selecting preamplifier means to select a respective one of said heads;

audio amplifier means receiving the signals from the preamplifier and applying it to a speaker means;

said latching track selector means activating a tape transport in response to sensing a switch closure;

spoken messages recorded on each track of said multitrack system in segmented lengths spaced along the length of tape;

at least one track of recorded messages being in a normal speaking voice;

at least one track of recorded messages being in a different speaking voice; and circuit means for turning off said multitrack tape recording/reproducing system whenever no recorded signal is sensed for a predetermined period of time on the track being reproduced.

2. The voice reproduction system of claim 1 wherein said turning off circuit means comprises a frequency detector which keeps said latching means from resetting as long as a certain low frequency tone is being detected.

3. The voice reproduction system of claim 2 wherein said certain low frequency tone is 40 Hz.

* * * * *